US006071252A

United States Patent [19]

Marcantoni

[11] Patent Number: 6,071,252

[45] Date of Patent: Jun. 6, 2000

[54] MASSAGING DEVICE HAVING A VERY SIMPLE STRUCTURE AND USABLE DIRECTLY OR INSERTABLE IN THE BACK OF MASSAGE CHAIRS OR THE LIKE

[75] Inventor: Egidio Marcantoni, Pesaro, Italy

[73] Assignee: C.I.A.R. S.r.l., Pesaro, Italy

[21] Appl. No.: 09/161,240

[22] Filed: Sep. 28, 1998

[30] Foreign Application Priority Data

Oct. 28, 1997 [IT] Italy ..... MI970768 U

[51] Int. Cl.[7] ..... A61H 15/00

[52] U.S. Cl. ..... 601/115; 601/98; 601/99; 601/112; 601/113

[58] Field of Search ..... 601/112, 113, 601/115, 116, 118, 86, 89–94, 97–103, 49–52, 122, 126–128, 130; 297/284.1

[56] References Cited

U.S. PATENT DOCUMENTS 4,149,531 4/1979 Tanaka et al. .
4,458,675 7/1984 Nakao et al. ..... 601/102
4,718,408 1/1988 Barreiro .
4,915,448 4/1990 Morgenstern ..... 297/284
5,137,016 8/1992 Yamasaki et al. .
5,460,598 10/1995 Yamasaki et al. ..... 601/99
5,462,516 10/1995 Anderson ..... 601/99
5,807,288 9/1998 Wu ..... 601/99

*Primary Examiner*—Richard J. Apley
*Assistant Examiner*—Justine R. Yu
*Attorney, Agent, or Firm*—Guido Modiano; Albert Josif; Daniel O'Byrne

[57] ABSTRACT

A massaging device having a very simple structure, which can be used directly or can be inserted in the back of massage chairs or the like comprises a post which supports, so that it can slide in a substantially vertical direction, a movable framework provided with massage wheels. Elements are provided for the translatory motion of the framework along the post to move the massage wheels in substantially vertical directions to perform a massaging action of the so-called "stretching" type. The structural simplicity of the device allows to significantly contain its production costs.

6 Claims, 3 Drawing Sheets

MASSAGING DEVICE HAVING A VERY SIMPLE STRUCTURE AND USABLE DIRECTLY OR INSERTABLE IN THE BACK OF MASSAGE CHAIRS OR THE LIKE

BACKGROUND OF THE INVENTION

The present invention relates to a massaging device having a very simple structure, which can be used directly or can be inserted in the back of massage chairs or the like.

Conventional massaging devices are meant to be inserted in the back of massage chairs or the like.

These massaging devices generally comprise a movable framework which is supported, so that it can slide in a substantially vertical direction, by a fixed frame which can be constituted by the frame of the chair or by an auxiliary frame. The movable framework supports two arms which in turn support massage wheels which can rotate about respective axes which are substantially horizontal or slightly inclined with respect to the horizontal. The arms are connected to eccentric portions or to articulations of shafts which are mounted on the movable framework and are arranged so that their axes are horizontal. The shafts can be rotated about their respective axes by means of one or more motors mounted on the movable framework.

By means of the rotation of said shafts, due to the connection to the arms, the massage wheels are moved in a mainly vertical direction or in a mainly horizontal direction, so as to effectively perform a massage of the so-called "stretching" or "tapping" type according to the requirements of the user, who lies so that his back rests on the back of the chair inside which the massaging device is accommodated.

Although these massaging devices are appreciated because of the effects that they achieve, they have the drawback that they have a relatively high cost which arises from their structural complexity and is a significant obstacle for the potential buyer.

SUMMARY OF THE INVENTION

The aim of the present invention is to obviate this drawback by providing a massaging device which can perform an acceptable massaging action despite having a very simple structure which can be manufactured with considerably lower costs than conventional massaging device.

Within the scope of this aim, an object of the invention is to provide a massaging device which can be easily accommodated inside the back of massage chairs or mounted on a frame to be used directly by the user.

Another object of the invention is to provide a massaging device which by virtue of its extreme structural simplicity is practically maintenance-free.

Another object of the invention is to provide a massaging device which is highly reliable in operation.

This aim, these objects and others which will become apparent hereinafter are achieved by a massaging device, characterized in that it comprises a post which supports, so that it can slide in a substantially vertical direction, a movable framework provided with massage wheels, means being provided for the translatory motion of said framework along said post.

BRIEF DESCRIPTION OF THE DRAWINGS

Further characteristics and advantages of the present invention will become apparent from the detailed description of a massaging device according to the invention, illustrated only by way of non-limitative example in the accompanying drawings, wherein.

DESCRIPTION OF THE PREFERRED EMBODIMENTS

Figure 1:
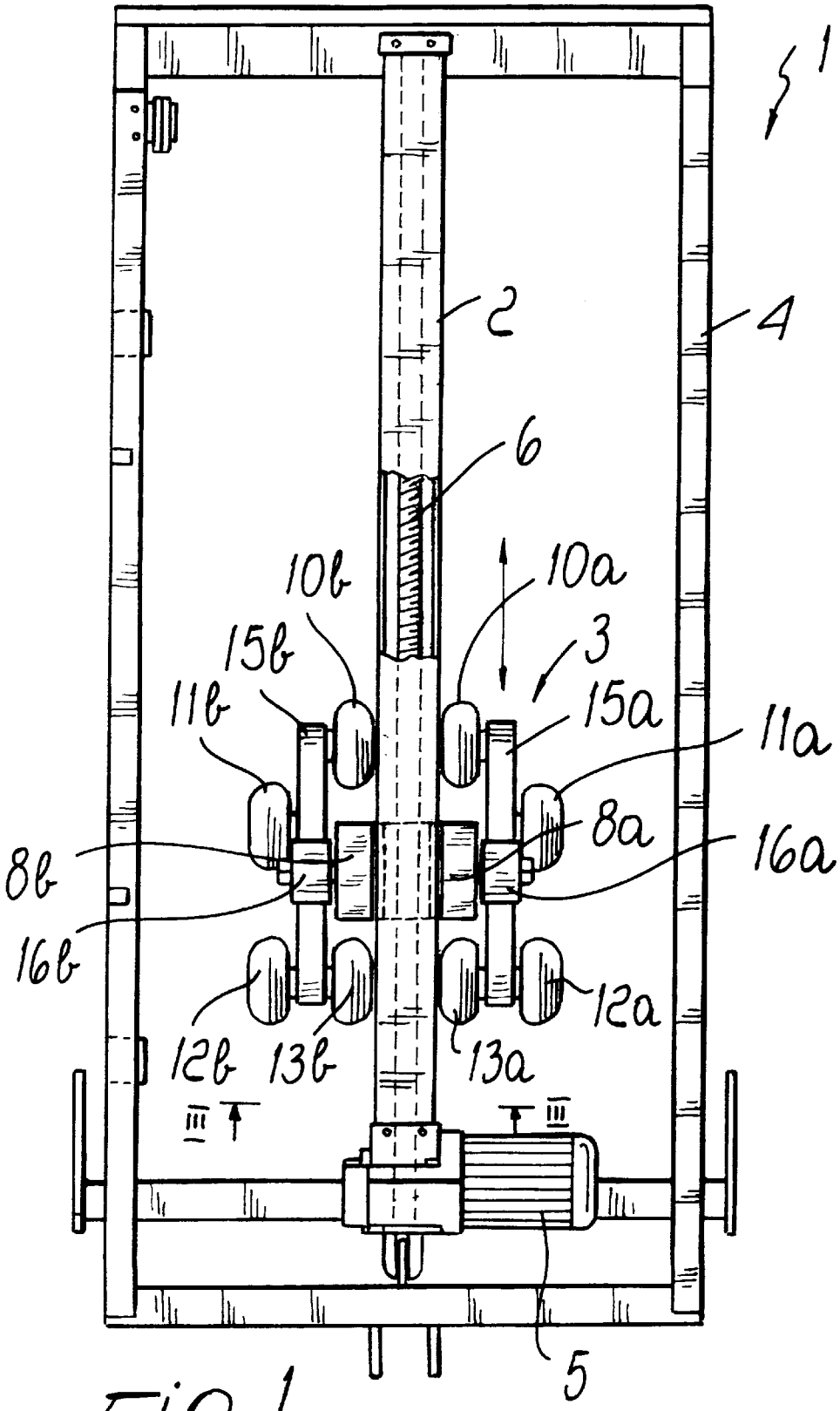
FIG. 1 is a schematic rear elevation view of the massaging device according to the present invention.
Figure 2:
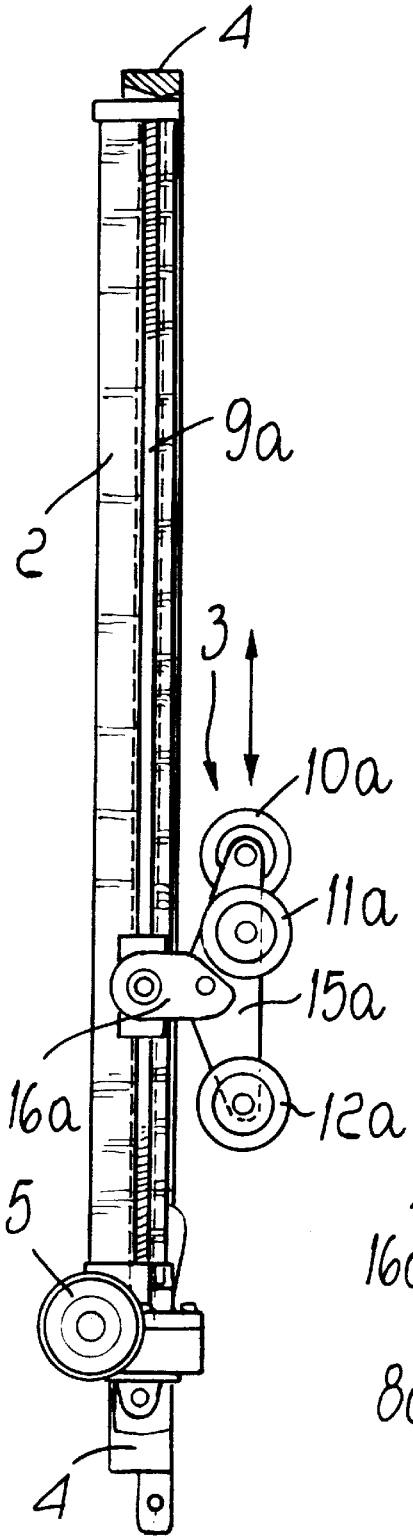
FIG. 2 is a schematic lateral elevation view of the massaging device according to the present invention, in which the supporting frame is shown only partially for the sake of clarity.
Figure 5:
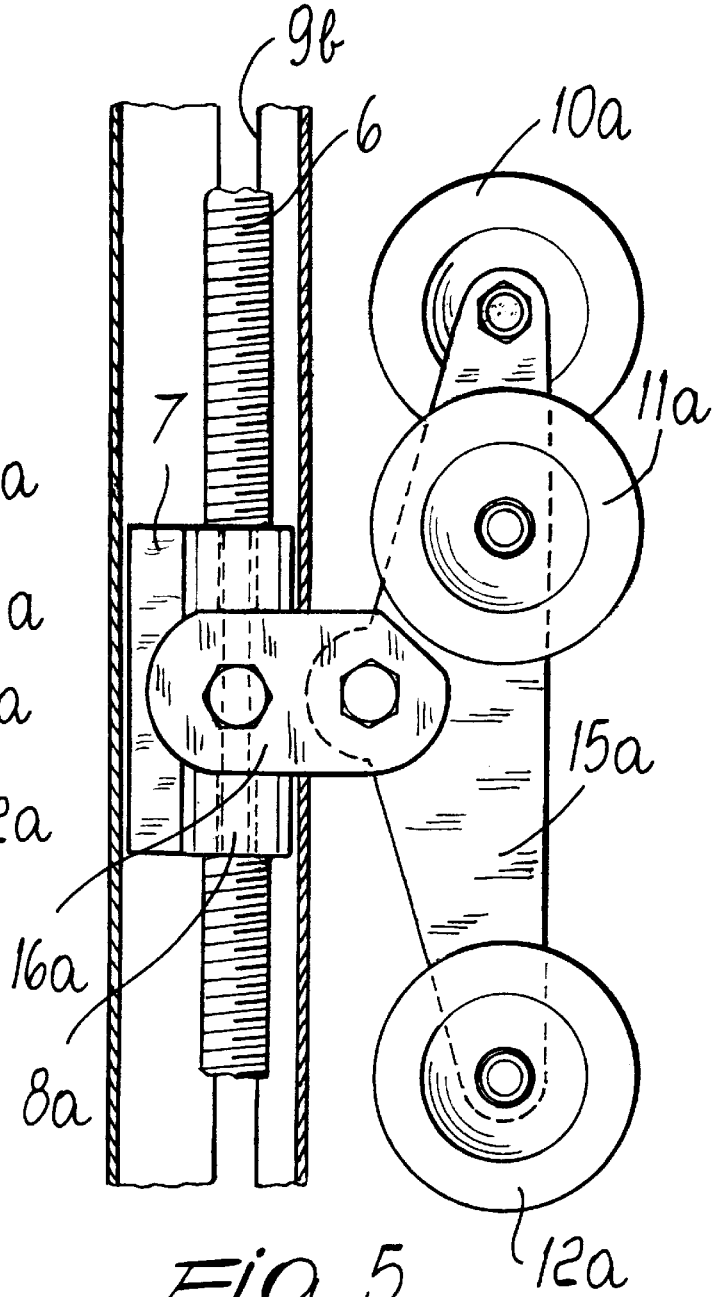
FIG. 5 is an enlarged-scale sectional view of a detail of FIG. 2.
Figure 3:
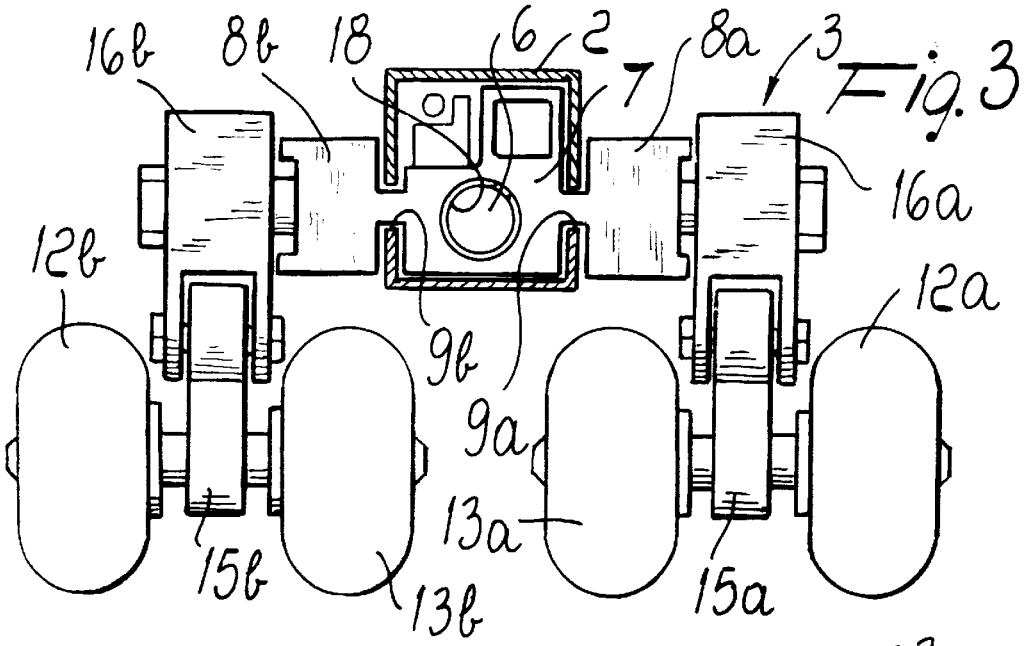
FIG. 3 is a sectional view of FIG. 1, taken along the plane III—III.
Figure 4:
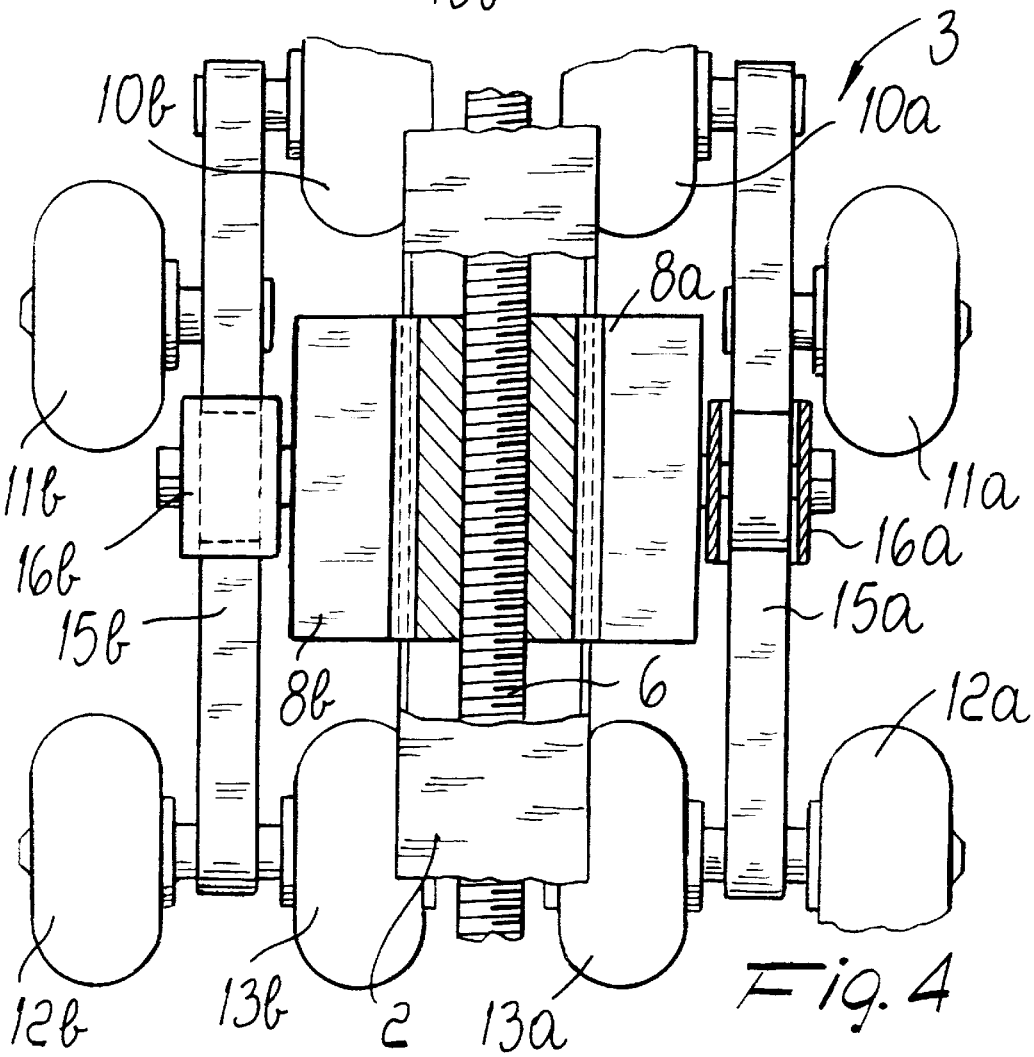
FIG. 4 is an enlarged-scale sectional view of a detail of FIG. 1.

With reference to the above figures, the massaging device according to the invention, generally designated by the reference numeral 1, comprises a substantially vertical post 2 which supports, so that it can slide in a substantially vertical direction, a movable framework 3 which in turn supports massage wheels so that they can rotate about their respective axes.

The device is provided with means for the translatory motion of the framework 3 along the post 2 in order to apply, by means of the massage wheels, a massaging action of the so-called "stretching" type.

More particularly, the post 2, which according to the requirements can be fixed to an adapted frame, generally designated by the reference numeral 4, or can be inserted in the back of massage chairs or the like and fixed to the supporting structure of the chair, has a substantially box-like shape, preferably with a rectangular or square cross-section.

The translatory motion means comprise a gearmotor 5, which is connected, by means of its output shaft, to a threaded shaft 6 which is accommodated inside the post 2, which is hollow.

The threaded shaft 6 is arranged vertically and is coupled to a female thread 18 formed inside a portion of the framework 3.

Conveniently, the framework 3 comprises a block which is preferably made of molded synthetic material and is substantially constituted by a central portion 7, which is slidingly accommodated inside the post 2 and in which the female thread 18 is formed, and by two lateral portions 8*a* and 8*b* which protrude laterally, on mutually opposite sides, from the post 2 through adapted vertical slots 9*a* and 9*b* formed on the two mutually opposite lateral walls of the post 2.

The massage wheels, designated by the reference numerals 10*a*, 10*b*, 11*a*, 11*b*, 12*a*, 12*b*, 13*a*, 13*b*, are supported, so that they can rotate about their respective axes, which are preferably arranged horizontally, by a pair of arms 15*a* and 15*b* which are fixed, by means of a corresponding cross-member 16*a* and 16*b*, to the lateral portions 8*a* and 8*b* of the block of the framework 3.

Each arm 15*a* and 15*b* is arranged on a substantially vertical plane and supports two wheels, in the illustrated case the wheels 10*a* and 13*a* for the arm 15*a* and the wheels 10*b* and 13*b* for the arm 15*b*, on one side, and two other wheels, i.e., the wheels 11*a* and 12*a* respectively for the arm 15*a* and the wheels lib and 12*b* for the arm 15*b*, on the opposite side.

The wheels 10*a* and 10*b* are spaced in an upward region from the wheels 11*a* and 11*b*, while the wheels 12*a* and 12*b* are arranged coaxially to the wheels 13*a* and 13*b*.

The arrangement of the massage wheels can be changed according to the requirements related to the massaging action to be performed.

The operation of the massaging device according to the invention is as follows.

By actuating the gearmotor 5, the threaded shaft 6 is rotated in one direction or the other, so as to achieve the alternating translatory motion of the framework 3 along the post 2 and, accordingly, the translatory motion of the massage wheels in a substantially vertical direction.

The massage wheels, by making contact with the back of the user, who rests against the back of the massage chair or directly against the massage wheels, effectively perform a massaging action of the stretching type.

It should be noted that the massaging device according to the invention is composed of a very small number of elements and that the massaging action is achieved by using exclusively a gearmotor which moves the movable framework 3, which supports the massaging wheels, along the post 2.

In practice, it has been observed that the massaging device according to the invention fully achieves the intended aim, since by virtue of its extreme structural simplicity it can be manufactured and therefore marketed at considerably lower costs than conventional massaging device.

In practice, the materials used, as well as the dimensions, may be any according to the requirements and the state of the art.

The disclosures in Italian Utility Model Application No. MI97U000768 from which this application claims priority are incorporated herein by reference.

What is claimed is:

1. A massaging device, comprising a post which supports, so that it can slide in a substantially vertical direction, a movable framework provided with massage wheels, means being provided for the translatory motion of said framework along said post;

said translatory motion means comprising a motor having an output shaft connected to a threaded shaft which has a vertical axis and is coupled to a female thread formed in a portion of said movable framework;

said movable framework comprising a block which is coupled to said post so that so it can slide in said substantially vertical direction, said female thread being formed in said block;

said block comprising a central portion which is slidingly accommodated in said post, which is hollow, and two lateral portions which protrude laterally, on mutually opposite sides, from said post through vertical slots formed on two mutually opposite lateral walls of said post.

2. The device according to claim 1, wherein said threaded shaft is accommodated inside said post.

3. The device according to claim 1, wherein each one of said two lateral portions supports an arm which supports said massage wheels so that said wheels can rotate about their respective axes.

4. The device according to claim 1, wherein said arm is arranged on a substantially vertical plane and supports said massage wheels so that said wheels can rotate about their respective horizontally arranged axes.

5. The device according to claim 3, wherein said arm supports two massage wheels on one side and two wheels on its opposite side.

6. The device according to claim 5, wherein two of the wheels arranged on the two opposite sides of said arm are substantially mutually coaxial.

* * * * *